United States Patent [19]

Beem

[11] 4,268,258

[45] May 19, 1981

[54] MOUNTING ARRANGEMENT FOR ELECTRIC OUTBOARD MOTOR

[75] Inventor: W. Wayne Beem, Zion, Ill.

[73] Assignee: Outboard Marine Corporation, Waukegan, Ill.

[21] Appl. No.: 79,488

[22] Filed: Sep. 27, 1979

[51] Int. Cl.[3] ..... B63H 21/26

[52] U.S. Cl. ..... 440/63; 248/642

[58] Field of Search ..... 440/53, 62, 63, 6; 248/640, 641, 642

[56] References Cited

U.S. PATENT DOCUMENTS

| | | | |
|---|---|---|---|
| 3,119,365 | 1/1964 | Evans | 248/642 |
| 3,245,640 | 4/1966 | Ibbs | 248/642 |
| 3,604,674 | 9/1971 | Wilkerson | 248/642 |
| 3,674,228 | 7/1972 | Horton | 440/62 |
| 3,724,790 | 4/1972 | Harris et al. | 440/62 |
| 3,765,369 | 10/1973 | Henning | 440/63 |
| 3,861,628 | 1/1975 | Krieger | 248/642 |
| 3,870,258 | 3/1975 | Shimanckas et al. | 440/62 |
| 3,874,318 | 4/1975 | Langley | 440/63 |
| 3,948,204 | 4/1976 | Brock et al. | 440/62 |
| 3,948,472 | 4/1976 | Metcalf | 248/642 |

*Primary Examiner*—Trygve M. Blix
*Assistant Examiner*—Jesús D. Sotelo
*Attorney, Agent, or Firm*—Michael, Best & Friedrich

[57] ABSTRACT

An outboard motor mounting arrangement including a mounting bracket adapted to be mounted on a boat hull, a support bracket mounted on the elongated motor tube for relative rotational and axial movement, a support arm pivotally connected to the support bracket and to the mounting bracket for pivotal movement of the outboard motor between a generally upright operating position and a generally horizontal storage position parallel to the boat hull, and a steering friction member mounted on the motor tube for adjustable frictional engagement therewith. The steering friction member is releasably coupled with the support bracket to prevent relative rotation therebetween when the outboard motor is in the operating position and is automatically uncoupled therefrom in response to movement of the support arm from the operating position toward the storage position to permit free rotation of the motor tube relative to the support bracket and thereby facilitate turning of the lower unit of the motor to the storage position.

13 Claims, 6 Drawing Figures

MOUNTING ARRANGEMENT FOR ELECTRIC OUTBOARD MOTOR

BACKGROUND OF THE INVENTION

This invention relates to mounting arrangements for outboard motors and, more particularly, to mounting arrangements for small electric outboard motors used for trolling or the like.

Such motors are mounted on a boat in a manner so that they can be withdrawn from the water and retained inside of the boat in a retracted or storage position when the boat is being propelled at normal speed by a higher horse power motor or being transported. For the sake of convenience, the motor mounting arrangement desirably should be arranged in a manner to afford movement of the motor between an extended or operating position and the storage position with a minimum of effort and without having to manually adjust the position of the motor. Also, in order to avoid damage to the motor when in shallow water or an underwater obstruction is encountered unexpectedly, the mounting arrangement desirably should permit a quick upward movement of the motor with minimum restraint.

Examples of prior art outboard mounting arrangements are disclosed in the following U.S. Patents:

| INVENTOR | U.S. PAT. NUMBER | ISSUE DATE |
|---|---|---|
| Evans | 3,119,365 | Jan. 28, 1964 |
| Ibbs | 3,245,640 | April 12, 1966 |
| Wilkerson | 3,604,674 | Sept. 14, 1971 |
| Horton | 3,674,228 | July 4, 1972 |
| Harris et al | 3,724,790 | April 3, 1972 |
| Henning | 3,765,369 | Oct. 16, 1973 |
| Kreiger | 3,861,628 | Jan. 21, 1975 |
| Shimanckas et al | 3,870,258 | March 11, 1975 |
| Langley | 3,874,318 | April 1, 1975 |
| Metcalf | 3,948,472 | April 6, 1976 |

SUMMARY OF THE INVENTION

The invention provides an outboard motor mounting arrangement including a mounting bracket adapted to be mounted on the boat hull, a support bracket mounted on an elongated member connecting the upper and lower units of the motor for rotational and axial movement of the elongated member relative to the support bracket, a support arm pivotally connected to the support bracket and to the mounting bracket for pivotal movement of the outboard motor between storage and operating positions, a steering friction member mounted on the elongated member for adjustable frictional engagement therewith, means for releasably holding the steering friction member in a stationary position wherein rotation of the steering friction member relative to the support bracket is prevented when the outboard motor is in the operating position, and means for moving the steering friction member, in response to movement of the support arm from the operating position toward the storage position, from the stationary position to a second position wherein rotation of the steering friction member, along with the elongated member, about the axis of the elongated member is permitted.

In one embodiment, the means for holding the steering friction member releasably couples the steering friction member with the support bracket and the means for moving the steering friction member to the second position uncouples the steering friction member from the support bracket.

In another embodiment, the mounting arrangement includes means for rotating the support bracket relative to the support arm in response to movement of the support arm between the operating and storage positions and the uncoupling means includes an element on the support arm which operatively cooperates with the steering friction member to move the steering member away from the support bracket in response to rotation of the support bracket relative to the support arm.

In another embodiment, the uncoupling means further includes a boss on the friction steering member and the element comprises a lift arm extending from the support arm for engaging the boss to move the steering friction member in a axial direction away from the support bracket in response to rotation of the support bracket relative to the support arm.

In another embodiment, the boss is provided with an arcuate camming surface which, in cooperation with the lift arm, rotates the steering friction member and the lower unit relative to the support bracket from an operating position toward a resting position.

One of the principal features of the invention is the provision of an outboard motor mounting arrangement which affords movement of the motor between an operating position and a storage position with minmum effort.

Another of the principal features of the invention is the provision of an outboard motor mounting arrangement including an adjustable friction member which is releasably coupled to a motor support bracket and can be uncoupled to permit free rotation of the motor relative to the support bracket in response to movement of the outboard motor from the operating position toward the storage position.

Another of the principal features of the invention is the provision of such a mounting arrangement including means for automatically rotating the lower unit toward a resting position in response to the movement of the outboard motor from the operating position to the storage position.

Other features and advantages of the invention will become apparent to those skilled in the art upon reviewing the following detailed description, the drawings and the appended claims.

Figure 2:
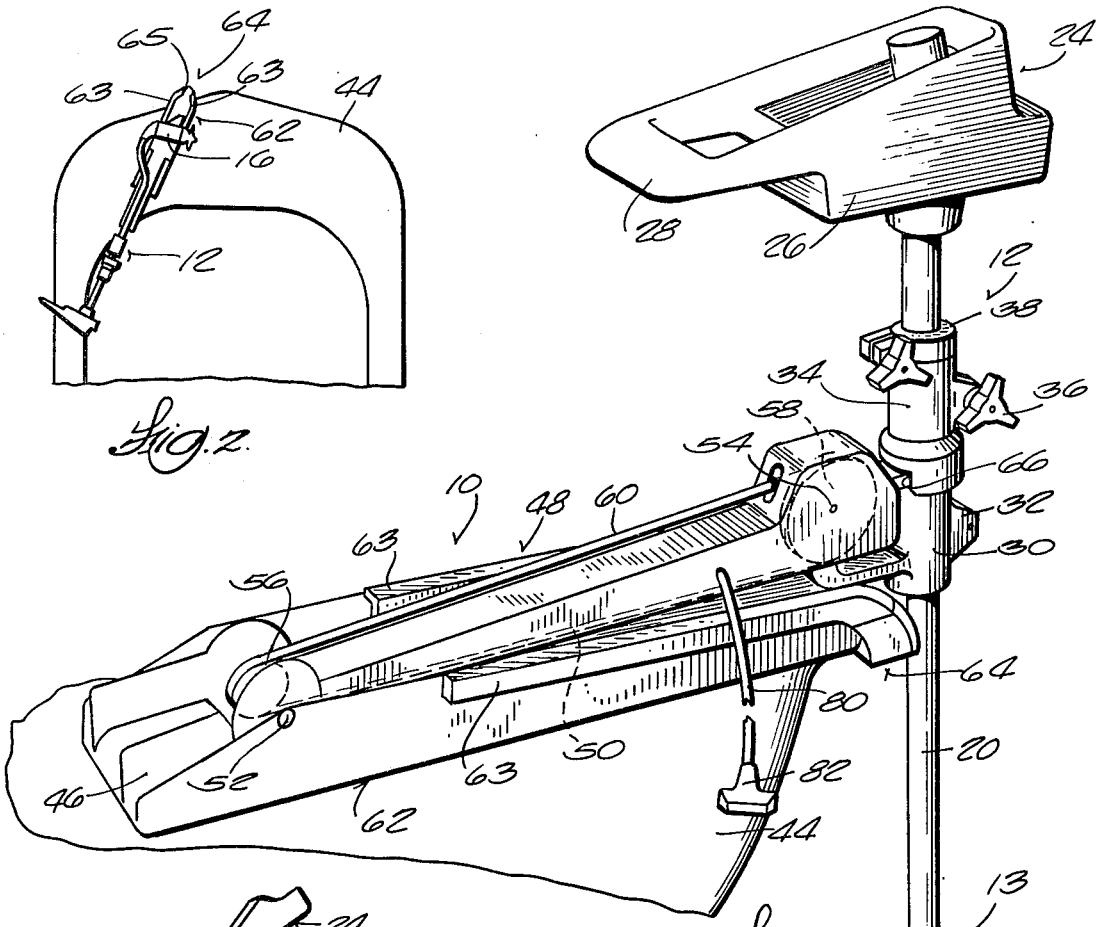
FIG. 2 is a reduced, fragmentary top plan view of a boat hull with the mounting arrangement and an outboard motor shown in the storage position.

Before explaining the invention in detail, it is to be understood that the invention is not limited in its application to the details of construction and the arrangements of the components set forth in the following description or illustrated in the drawings. The invention is capable of other embodiments and of being practiced and carried out in other various ways. Also, it is to be understood that the phraseology and terminology employed herein is for the purposes of description and should not be regarded as limiting.

DESCRIPTION OF THE PREFERRED EMBODIMENTS

Illustrated in the drawings is a mounting arrangement 10 for an outboard motor 12 having a propulsion unit 13 including a lower unit 14 which has an immersible housing 16 embodying an electric motor (not shown) for driving a propeller 18 rotatably mounted in the housing 16. The lower unit 14 is mounted on the lower end of an elongated motor tube 20 which carries suitable wiring connecting the lower unit motor to a boat battery (not shown). Depending from the housing 16 is a skeg 22.

The outboard motor 12 also has an upper unit 24 which is connected to the upper end of the motor tube 20 and includes a housing 26 by which the motor tube 20 can be selectively rotated for steering the lower unit 14 via a handle 28 formed as an integral part of the housing 26.

A support bracket 30 is relatively loosely mounted on the motor tube 20, such as by a clamp 32, for rotational and axial movement of the motor tube 20 relative to the support bracket 30 via a pair of split bushings 33. The clamp 32 can be tightened to eliminate wobbling motion of the motor tube 20 relative to the support bracket 30.

Rotation of the motor tube 20 during steering is frictionally restrained by a steering friction member 34 mounted on the motor tube 20 above the support bracket 30. The steering friction member 34 is made from a non-galling material, such as glass-reinforced nylon, and is releasably coupled to the support bracket 30 as described in more detail below to prevent rotational movement of the firction member 34 relative to the support bracket 30 when the outboard motor 12 is in the operating position. The steering friction member 34 includes a suitable means, such as a clamp 36, for selectively adjusting the rotational friction applied on the motor tube 20.

Fixedly mounted on the motor tube 20 is a stop member 38 which engages the friction steering member 34 and limits the depth at which the lower unit 14 is submerged in the water. The stop member 38 preferably is mounted on the motor tube 20 for selective axial movement relative to the motor tube 20 so that the submersion depth of the lower unit 14 can be adjusted. In a specific construction illustrated, the stop member 38 is in the form of a split sleeve clamp which can be tightened into gripping engagement with the motor tube 20 by tightening a threaded thumb bolt 42.

Figure 1:
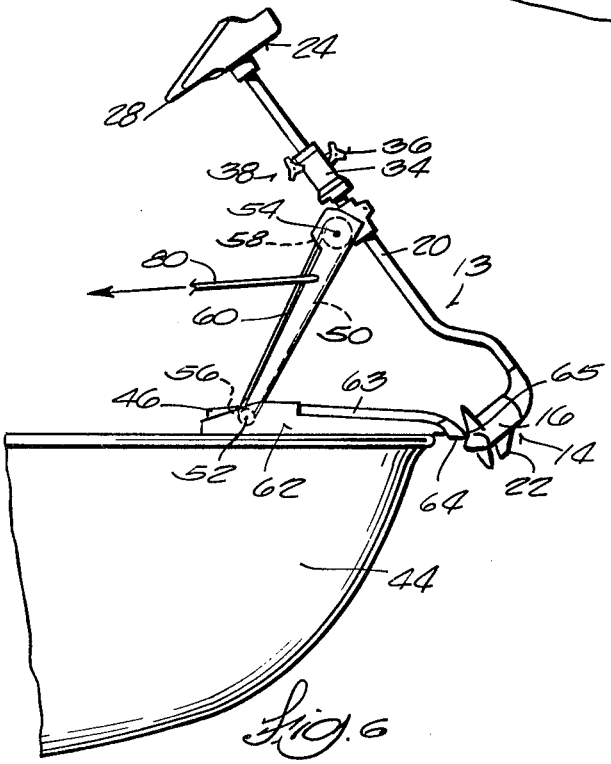
FIG. 1 is a perspective view of the outboard motor mounting arrangement embodying various of the features of the invention with the mounting arrangement and an outboard motor shown in the operating position.

Fixedly mounted on a boat hull 44 (FIGS. 1 and 2) is a mounting bracket 46. The outboard motor 12 is supported from the mounting bracket 46 by a support assembly 48 which provides pivotal movement of the outboard motor 12 relative to the mounting bracket 46 between an operating position wherein the motor tube 20 is generally upright outboard of the boat and the lower unit is submerged in the water (FIG. 1) and a storage position wherein the motor tube 20 is generally horizontal and the lower unit 14 is located inboard of the boat (FIG. 2). While other suitable arrangements can be used, in the specific construction illustrated, the support assembly 48 generally is arranged in the manner described in the Shimanckas et al. U.S. Pat. No. 3,870,258 which is incorporated herein by reference.

More specifically, the support assembly 48 includes a support arm 50 connected at one end to the mounting bracket 46 for pivotal movement about a first axis 52 and connected at the other end to the support bracket 30 is rotated through an arc of about 90° in response to movement of support arm 50 between the storage and operating positions, via a cable-pulley arrangement like that disclosed in the Shimanckas et al. U.S. Pat. No. 3,370,258.

More particularly, the support assembly 48 (FIG. 1) includes a pulley 56 rotatably mounted coaxially with the pivotal connection between the support arm 50 and the mounting bracket 46 and a pulley part 58 having a radius approximately twice the radius of the pulley part 56 and forming a fixed part of the support bracket 30. The pulley part 58 is located coaxially with the pivotal connection between the support bracket 30 and the support arm 50. A flexible cable 60 is reeved about the pulley 56 and the pulley part 58, is connected at both ends to the mounting bracket 46 and is fixedly connected, intermediate its ends, to the pulley part 58 so as to prevent relative movement therebetween.

During pivotal movement of the support bracket 50 relative to the mounting bracket 46, the cable 60 causes rotation of the support bracket 30 relative to the support arm 50. Since the radius of the pulley 56 is approximately one-half the radius of the fixed pulley part 58 on the support bracket 30, the movement of the support bracket 30 is approximately one-half the angular movement of the support bracket 50 relative to the mounting of bracket 46. Thus, as the support arm 50 swings through about 180° between the operating and storage positions, the support bracket 30 swings through an arc relative to the support arm 50 of about 90° to locate the motor tube 20 in a generally upright operating position and to locate the motor tube 20 in a generally horizontal storage position.

Mounted on the boat hull 44 and extending, in large part, forwardly of the mounting bracket 46 is a motor rest assembly 62 including a pair of laterally-spaced, non-scuffing bumpers 63 on which the motor housing 16 rests when the outboard motor 12 is in the storage position (FIG. 2). In that position, the motor housing 16 is rotated approximately 90° about the axis of the motor tube 20 from its orientation in the operating position.

Located adjacent the forward end of the motor rest assembly 62 and extending outboard of the boat hull 44 is a guide 64 having a pointed nose 65 which is engaged by the motor housing 16 during movement of the support arm 50 toward the storage position and cams (i.e., rotates) the motor housing 16 about the axis of the motor tube 20 toward the storage position as explained in more detail below.

Figures 3, 4, 5:
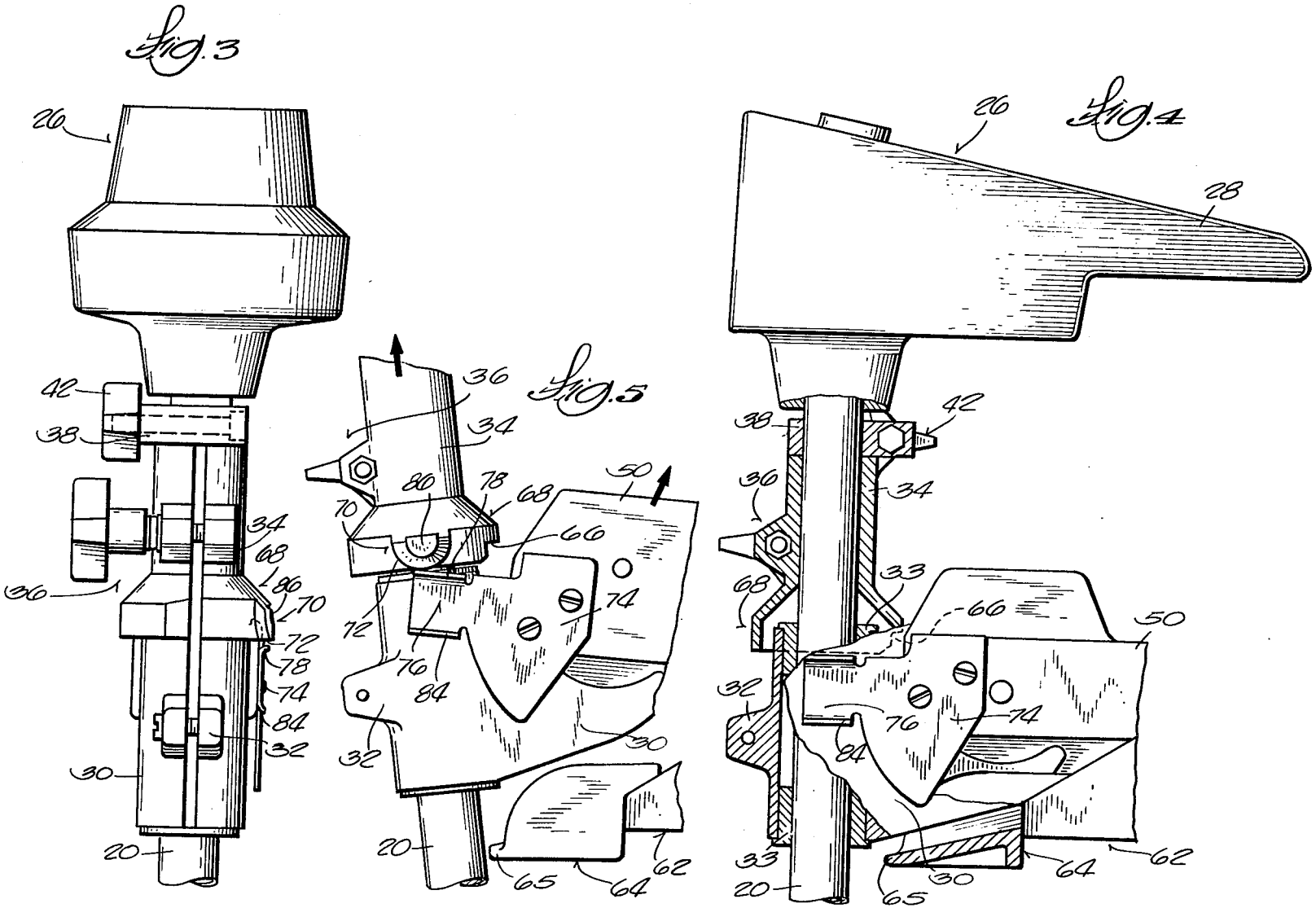
FIG. 3 is a fragmentary, elevational view of the mounting arrangement shown in FIG. 1.
FIG. 4 is a fragmentary, partially broken away, side elevational view of the mounting arrangement shown in FIG. 1.
FIG. 5 is a fragmentary, side elevational view showing the location of various parts of the mounting arrangement during initial movement from the operating position toward the storage position.

Means are provided for releasably coupling the support bracket 30 with the steering friction member 34 to prevent relative rotation therebetween when the support bracket 30, and thus the outboard motor 12, is in the operating position. While other suitable arrangements can be used for this purpose, in the specific instruction illustrated, such means comprises providing (FIGS. 1,3 and 4) a slot or notch 66 in the lower portion 68 of the steering friction member 34 for fitting over a portion of the support bracket 30.

When the propulsion unit 13 is in the operating position, the support assembly 48 prevents further downward movement of the support bracket 30 and the motor tube 20 is freely moveable, either axially or rotationly, relative to the support bracket 30. Thus, the steering friction bracket 34 is clamped between the support bracket 30 and the stop number 38 by the weight of the outboard motor 12 bearing on the top or upper edge of the steering friction member 34 via the fixedly mounted stop member 38. The opposite edges of the notch 66 in the steering friction member 34 engage the opposite sides of the support bracket 30 to prevent rotation of the steering friction member 34 relative to the support bracket 30. Rotational movement of the motor tube 20, and thus the lower unit 14, relative to the support bracket 30 is frictionally restrained by the friction steering member 34.

Means are provided for uncoupling of the steering friction member 34 from the support bracket 30 in response to movement of the support arm 50 from the operating position towards the storage position. While various arrangements can be used, in the specific construction illustrated, such means (FIGS. 3–5) comprises a cam boss 70 having an arcuate surface 72 and located on the lower portion 68 of the steering friction member 34 and a lift arm 74 affixed on the support arm 50. The lift arm 74 has an extension 76 extending longitudinally outwardly from the end of the support arm 50 and having an upper edge 78 which is located beneath the cam boss 66 when a support arm 50 is in the operating position. The upper edge 78 bears against the arcuate surface 72 of the cam boss 70 as the support arm 50 is moved from the operating position towards the storage position.

Because of rotational movement of the support arm 50 relative to the support bracket 30, the extension 76 lifts against the cam boss 70, thereby separating the steering friction member 34 and clearing the notch 66 from the support bracket 50. When this occurs, the motor tube 20 is free to rotate relative to the support bracket 30. If the steering friction member 34 were not uncoupled from the support bracket 30, rotation of the lower unit 14 from the operating position to the orientation for resting on the rest assembly 62 would be restrained by friction applied on the motor tube 20 by the steering friction member 34.

As the support arm 30 is moved further towards the storage position, the upper edge 78 of the lift arm extension 76 cams around the arcuate surface of 72 on the cam boss 70, causing the steering friction member 34, to rotate counterclockwise (as viewed in FIG. 5) about the axis of the motor tube 20 through an angle of less than 90°. The friction applied on the motor tube 20 by the steering friction member 34 is sufficient for the motor tube 20, and thus the lower unit 14, to be rotated with the steering friction member 34. Thus, the motor housing 16 is partially rotated toward the orientation for storage on the motor rest assembly 62.

Figure 6:
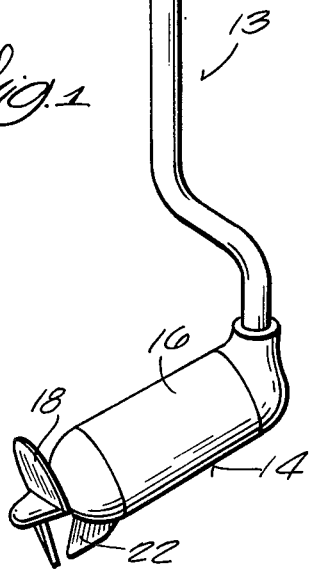
FIG. 6 is a reduced, side elevational view showing the location of various parts when the mounting arrangement is at a position intermediate the operating and storage positions.

When the support arm 50 reaches the position illustrated in FIG. 6, the partially rotated motor housing 16 engages the nose 65 on the motor rest assembly guide 64 and is cammed thereby to the storage position during subsequent movement of the support arm 50 towards the storage position. A spring-loaded latch (not shonw) or other suitable means can be provided for releasably latching the support arm 50 to the mounting bracket 46 when the support arm 50 is in either the storage or operating positions. This latch can be released by pulling (FIGS. 1 and 6) on a pull rope 80 including a handle 82. The pull rope 80 also can be used for raising the support arm 50 from either the operating or storage positions and controlling subsequent downward swinging movement toward either position.

In the event shallow water or a submerged obstruction is encountered unexpectedly, the lower unit 14 can be quickly raised to clear same by simply lifting vertically on the upper unit 26. The motor tube 20 slides freely within the support bracket 30 and the steering friction member 34 is carried with the motor tube 20. When the lower unit 14 is returned to the operating position with the steering friction member 34 coupled with the support bracket 30, the degree of steering friction remains the same without adjustment because there is no need to relieve the friction on the motor tube 20 to facilitate vertical movement.

When the outboard motor 12 is moved from the operating position to the storage position during normal operation, the steering friction member 34 is automatically uncoupled from the support bracket 30 by the lift arm extension 76 lifting on the cam boss 70, as explained above, to permit free rotation of the motor housing 16 to the storage position. The lift arm extension 76, acting on the arcuate surface 72 of the cam boss 70, rotates the motor housing 17 to a more desirable contact position with the nose 65 on the motor guide 64, thereby facilitating rotation of the motor housing 16 by the guide 64 to the storage position for resting on the motor rest assembly 62.

During movement of the support arm 50 from the operating position to the storage, the lift arm extension 76 eventually moves away from the cam boss 70. Means are provided for returning the lift arm extension 76 to an uncoupling position beneath the cam boss 70 when the outboard motor 12 is returned to the operating position.

In the specific construction illustrated, the lift arm 74 is made from a material, such as spring steel, which is rigid in the vertical plane (plane of support arm movement) and is resilient in a horizontal plane (plane perpendicular to the plane of support arm movement) and the extension 76 is provided with an outturned, arcuate lower edge 84. This permits the extension 76 to cam over the inclined outer surface 86 which is located on the cam boss 70 and which serves as a ramp and snap into place with the upper edge 78 located beneath the arcuate surface 72 of the cam boss 70. When the outboard motor 12 is moved from the storage position to the operating position, it is usually necessary to manually rotate the motor tube 20 to move the steering friction member 34 into the operating position with the notch 66 located over the support bracket 30.

Various of the features of the invention are set forth in the following claims.

I claim:

1. A mounting arrangement for an outboard motor including an upper unit, a lower unit carrying a propeller and means connecting the upper and lower units including an elongated member, said mounting arrangement comprising a mounting bracket adapted to be mounted on a boat hull, a support bracket mounted on the elongated member for rotational and axial movement of the elongated member relative to said support bracket, a support arm pivotally connected to said support bracket and to said mounting bracket for pivotal movement of the outboard motor relative to said mounting bracket between a storage position and an operating position, a steering friction member mounted on the elongated member for adjustable frictional engagement therewith so as to frictionally restrain rotational movement of the elongated member relative to said steering friction member, means for releasably holding said steering friction member in a stationary position wherein rotation of said steering friction member about the axis of the elongated member is prevented when the outboard motor is in the operating position, and means for moving said steering friction member, in response to movement of said support arm from the operating position toward the storage position, from the stationary position to a second position wherein rotation of said steering friction member about the axis of the elongated member is permitted.

2. A mounting arrangment according to claim 1 wherein said means for holding said steering friction member comprises means for releasably coupling said steering friction member to said support bracket to prevent relative rotation therebetween and wherein said means for moving said steering friction member to the second position comprises means for uncoupling said steering friction member from said support bracket.

3. A mounting arrangement according to claim 2 wherein said coupling means comprises a notch in said steering friction member for receiving a fixed portion of said support bracket when the outboard motor is in the operating position.

4. A mounting arrangement according to claim 2 including means for rotating said support bracket relative to said support arm in response to movement of said support arm between the operating and storage positions and wherein said uncoupling means includes an element on said support arm for operatively cooperating with said steering friction member to move said steering friction member away from said support bracket in response to rotation of said support bracket relative to said support arm.

5. A mounting arrangement according to claim 4 wherein said uncoupling means further includes a boss on said friction steering member and wherein said element comprises a lift arm extending from said support member for engaging said boss so as to move said steering friction member in an axial direction away from said support bracket in response to rotation of said support bracket relative to said support arm.

6. A mounting arrangement according to claim 5 wherein said boss includes an arcuate surface which is engaged by said lift arm and cooperates therewith to rotate said steering friction member and the elongated member about the axis of the elongated member in response to rotation of said support bracket relative to said support arm after said steering friction member is uncoupled from said support bracket.

7. A mounting arrangement according to claim 5 further including means for returning said lift arm to position beneath said boss in response to movement of said support arm from the storage position to the operating position.

8. A mounting arrangement according to claim 7 wherein said lift arm is made from a material which is rigid in a plane parallel to the plane of support arm movement and is resilient in a plane perpendicular to the plane of the support arm movement and said return means comprises a ramp surface on said boss for camming said lift arm to the position beneath said boss.

9. A mounting arrangement according to claim 1 including a stop member adapted to be mounted on the elongated member between said upper unit and said steering friction member so as to limit the submersion depth of the lower unit and means for adjusting the position of said stop member on the elongated member.

10. A mounting arrangement according to claim 1 including guide means adapted to be mounted on the boat hull for camming the lower unit to a storage position on its side in response to movement of the support arm from the operating position toward the storage position after said steering friction member has moved to the second position.

11. A mounting arrangement for an outboard motor including an upper unit, a lower unit carrying a propeller and means connecting the upper and lower units including an elongated member, said mounting arrangement comprising a mounting bracket adapted to be mounted on a boat hull, a support bracket mounted on the elongated member for rotational and axial movement of the elongated member relative to said support bracket, a support arm pivotally connected to said support bracket and to said mounting bracket for pivotal movement of the outboard motor relative to said mounting bracket between a storage position and an operating position, means for rotating said support bracket relative to said support arm in response to movement of said support arm between the operating and storage positions, a steering friction member mounted on the elongated member for adjustable frictional engagement therewith so as to frictionally restrain rotational movement of the elongated member relative to said steering friction member, means for releasably coupling said steering friction member with said support bracket to prevent relative rotation therebetween, said coupling means including a notch in said steering friction member for receiving a fixed portion of said support bracket, and means for uncoupling said steering friction member from said support bracket in response to movement of said support arm from the operating position toward the storage position, said uncoupling means including an element on said support arm for operatively cooperating with said steering friction member to move said steering friction member away from said support bracket.

12. A mounting arrangement according to claim 11 wherein said uncoupling means further includes a boss on said friction steering member and wherein said element comprises a lift arm extending from said support member for engaging said boss so as to move said steering friction member in an axial direction away from said support bracket in response to rotation of said support bracket relative to said support arm.

13. A mounting arrangement according to claim 12 wherein said boss includes an arcuate surface which is engaged by said lift arm and cooperates therewith to rotate said steering friction member and the elongated member about the axis of the elongated member in response to movement of said support arm from the operating position toward the storage position after said steering friction member is uncoupled from said support bracket.

* * * * *